US006457791B1

(12) United States Patent
Müterthies et al.

(10) Patent No.: US 6,457,791 B1
(45) Date of Patent: Oct. 1, 2002

(54) FASTENING ARRANGEMENT

(75) Inventors: Ralf Müterthies, Löhne (DE); Stefan Rüter, Bad Oeynhausen (DE); Carsten Meyer, Bielefeld (DE); Gerhard Schröder, Bad Oeynhausen (DE); Jörg Aufderheide, Spenge (DE); Rolf Mertes, Bad Salzuflen (DE)

(73) Assignee: Paul Hettich GmbH & Co., Kirchlengren (DE)

( * ) Notice: Subject to any disclaimer, the term of this patent is extended or adjusted under 35 U.S.C. 154(b) by 55 days.

(21) Appl. No.: 09/663,187

(22) Filed: Sep. 15, 2000

(30) Foreign Application Priority Data

Sep. 17, 1999 (DE) ..... 199 44 642

(51) Int. Cl.[7] ..... A47B 88/00

(52) U.S. Cl. ..... 312/348.4; 312/348.1; 312/330.1

(58) Field of Search ..... 312/330.1, 334.1, 312/334.7, 334.8, 334.14, 348.1, 348.2, 348.4

(56) References Cited

U.S. PATENT DOCUMENTS

| | | | | | |
|---|---|---|---|---|---|
| 3,029,357 | A | | 4/1962 | Williams | 312/348.1 |
| 3,549,301 | A | | 12/1970 | Harris et al. | 312/330.1 |
| 3,729,246 | A | | 4/1973 | Harrell et al. | 312/330.1 |
| 5,197,791 | A | | 3/1993 | Domenig | 312/348.1 |
| 5,281,022 | A | * | 1/1994 | Rock | 312/348.4 |
| 5,364,181 | A | * | 11/1994 | Scheible | 312/348.4 |
| 5,370,454 | A | | 12/1994 | Domenig | 312/348.1 |
| 5,433,518 | A | | 7/1995 | Skov | 312/348.1 |
| 5,460,443 | A | * | 10/1995 | Ferrari et al. | 312/348.4 |
| 5,611,637 | A | * | 3/1997 | Brustle et al. | 312/348.4 X |
| 5,688,033 | A | * | 11/1997 | Fleisch et al. | 312/348.4 |
| 5,860,718 | A | * | 1/1999 | Brustle | 312/348.2 |
| 6,027,194 | A | * | 2/2000 | Fleisch | 312/348.4 |

FOREIGN PATENT DOCUMENTS

| | | | | |
|---|---|---|---|---|
| DE | G 73 17 344.1 | | 5/1973 | |
| DE | GM 79 00 396 | | 6/1980 | |
| DE | 83 33 251.0 | | 3/1984 | |
| DE | 3931155 | * | 3/1991 | 312/348.4 |
| DE | 40 16 452 A1 | | 9/1991 | |
| DE | G 93 11 493.1 | | 11/1993 | |
| DE | G 94 07 813.0 | | 9/1994 | |
| DE | 19726466 A1 | | 12/1998 | |
| WO | WO 96/28995 | * | 9/1996 | |

* cited by examiner

*Primary Examiner*—James O. Hansen
(74) *Attorney, Agent, or Firm*—Barnes & Thornburg

(57) ABSTRACT

A fastening arrangement, particularly for front panels of drawers, has a fastening element which can be fastened on a rail of a pull-out slide, and a holding part which can be connected with a front panel. The holding part is prefixed relative to the fastening element such that an adjustment of the holding part with respect to the fastening element can be made into a first horizontal or vertical direction. The holding part is held on the fastening element by the prefixing in an original or adjusted position and can also be locked in a desired position. In addition, the holding part is held relative to the fastening element to be prefixed and adjustable into a second direction perpendicular to the first direction. For the prefixing, the fastening arrangement has a snap-type device, a catch device and an eccentric device.

4 Claims, 3 Drawing Sheets

FASTENING ARRANGEMENT

BACKGROUND AND SUMMARY OF THE INVENTION

The invention relates to a fastening used to fasten front panels of drawers on a pull-out slide.

Filed contemporaneously herewith are six United States patent applications, commonly assigned to Paul Hettich GmbH & Co.:

| INVENTOR(S) | TITLE | ATTY DOCKET |
|---|---|---|
| Müterthies, Rüter, et al. | Fastening Arrangement | 824/36771 |
| Müterthies, Rüter, et al. | Mounting Unit | 824/36772 |
| Müterthies, Rüter, et al. | Fastening Arrangement | 824/36773 |
| Müterthies, Rüter, et al. | Pull-out Slide Set | 824/36774 |
| Müterthies, Rüter, et al. | Partitioning System | 824/36775 |
| Müterthies, Rüter, et al. | Fastening Arrangement | 824/36785 |

The claims, drawings and specification of each of the foregoing applications is hereby specifically incorporated by reference into this specification as if set forth verbatim herein.

German Patent Document DE 79 00 396 U1 shows a fastening arrangement for a drawer in which a drawer front plate is provided with a fitting part used for fastening the front plate on a drawer. The fitting part has a surface with a vertical ribbing and another surface with a horizontal ribbing. These ribbings interact with corresponding ribbings on a fastening body arranged on the drawer. By means of the ribbings, after the establishment of the horizontal and vertical position with respect to the drawer, the front plate can be locked by means of an eccentric bolt Although this fastening device permits a variable fastening of the front plate on the drawer, it has the disadvantage that the mounting is difficult to carry out because the fitter must, on the one hand, hold the front plate in the desired position and, on the other hand, check the correct aligmnent in order to then lock the front plate in the desired position.

German Patent Document DE 94 07 813 U1 shows a fastening arrangement for adjustable front panels for drawers in which the front panel is prefixed at least in the vertical direction, so that the fitter can vertically adjust the front panel without having to hold the front panel in place during the entire time. For this purpose, a holding part is fastened directly on the front panel and interacts with a supporting part which is connected with a pull-out slide. The holding part and the supporting part are each provided with mutually engaging, horizontally extending teeth which mesh in the mounted position. As a result of the flexible construction of the toothing on the supporting part, the front plate can be adjusted in the vertical direction, the meshing teeth being offset with respect to one another. For locking the front plate, the toothings are pressed upon one another by means of an eccentric device so that vertical adjustment is prevented.

Although the fastening device provides the fitter with a certain mounting aid, a prefixing in the horizontal direction cannot be achieved by means of this fastening arrangement. The alignment of the front plate in the horizontal direction takes place by a displacement of the holding part relative to the supporting part to the extent that this is possible. However, since the supporting part is preadjusted to a center position, a horizontal displacement can take place only by the application of a certain prestress by the fitter. This approach is uncomfortable because the fitter must simultaneously carry out the prestressing for the horizontal alignment and the checking of the correct position. This difficulty during the assembly can result in faulty alignments. The known fastening arrangement is therefore unsuitable particularly when high quality-related demands are made on the mounting precision.

It is therefore an object of the invention to provide a fastening arrangement having a fastening element and a holding part, in the case of which a simple alignment of the holding part relative to the fastening element can be achieved in at least two directions. As a result, by means of a corresponding prefixing, the mounting of a furniture part, such as a front panel of a drawer, is to be facilitated.

This object is achieved by means of a fastening arrangement having a fastening element attached to a rail of a pull-our slide and a holding element attached to a front drawer panel and cooperating with the fastening element such that it is adjustable in both a horizontal and vertical direction. If the holding part is prefixed with respect to the fastening element such that it can be adjusted horizontally as well as vertically into the desired mounting position, the mounting operation will be considerably simplified. The fitter must only align the holding part into the desired position without holding the front plate or similar components. The prefixing will provide the holding part with the necessary stability so that it cannot easily be moved. As soon has the holding part is aligned in the desired position relative to the fastening element, the holding part will be locked on the fastening element.

According to a preferred embodiment of the invention, the first and the second direction extend parallel to a front plate plane and the holding part can be adjusted separately into the first or second direction. This permits, for example, a simple alignment of the individual end edges of a drawer front plate.

If a snap-type device is provided which holds the holding part on the fastening element in the prefixed position, the fastening arrangement can easily be mounted without the requirement of tools for the mounting.

A catch device is preferably provided which prefixes the holding part on the fastening part at least in one direction. This permits a step-by-step adjustment of the holding part on the fastening element, in which case, the catching noises can be used as an orientation aid during the mounting. The catch device can, for example, be constructed of several ribs, one tip respectively engaging between these ribs.

According to another embodiment, an eccentric device is provided by means of which the holding part is held on the fastening element so that it is movable in one of the directions. The eccentric device permits a continuous adjustment of the holding part. A particularly stable prefixing of the holding part on the fastening element is achieved when a combination of a snap-type device, a catch device and an eccentric device is provided so that the advantages of these devices supplement one another. In this case, the eccentric device can displace the holding part with respect to the fastening element preferably in the vertical direction because then a particularly stable prefixing is achieved by means of clamping forces in this direction and the vertical weights usually represent the highest stress for the prefixing.

A simple eccentric device, which can be produced at reasonable cost, can be obtained when a rotatable disk is provided on the fastening element, on which disk a pin is arranged eccentrically with respect to the pivot, which pin engages in a slot in the holding part. In this case, the disk can consist of a plastic material and can be cast onto a metal section of the fastening element.

According to another embodiment of the invention, the snap-type device has two side flanges on the holding part which are applied to the fastening element, particularly to a head of the fastening element. If the side flanges have projections which extend diagonally to the interior, a clamping force can be generated by the snap-type device, which clamping force, for example, presses the components of the catch device on one another. In this case, the elasticity of the snap-type device can ensure a good prefixing of the catch device.

A good guidance of the holding part on the fastening element is obtained if the holding part can be displaced along the ribs of the catch device by means of the eccentric device.

A simple form of locking the holding on the fastening element is achieved by a second eccentric device which presses the catch device together so that the holding part and the fastening element are held together by means of clamping forces.

This eccentric device is preferably formed by a removable component which has a pivot and an eccentric section formed offset with respect to the pivot, a head of a crosstip screwdriver being integrally constructed on one side of the eccentric section in a centered position with respect to the pivot. This permits the mounting of the fastening device completely without any tool because the adjustment of the fastening arrangement and the locking can take place by means of this component.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
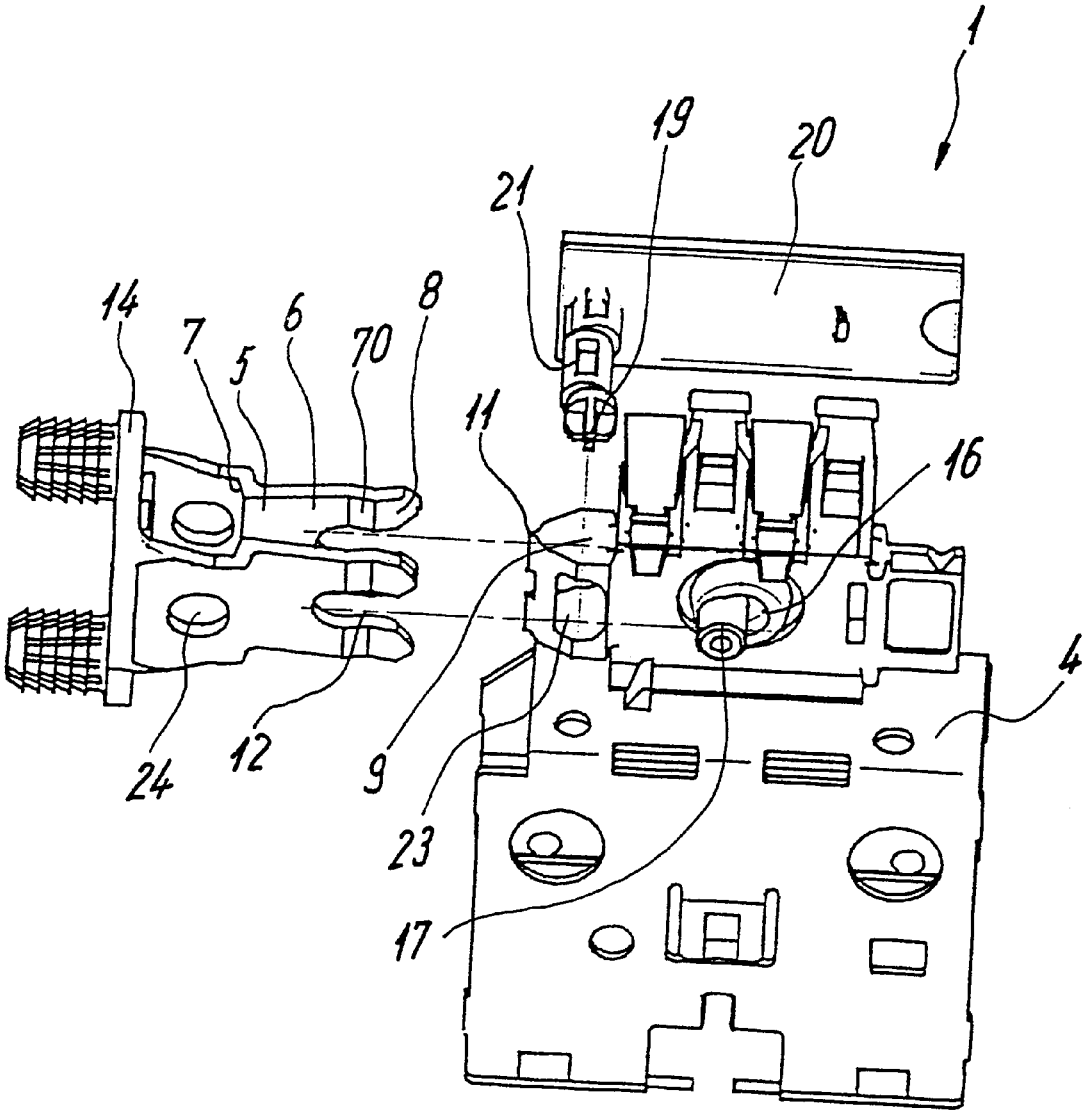
FIG. 1 is a perspective exploded view of an embodiment of a fastening arrangement according to the invention diagonally from above.
Figure 2:
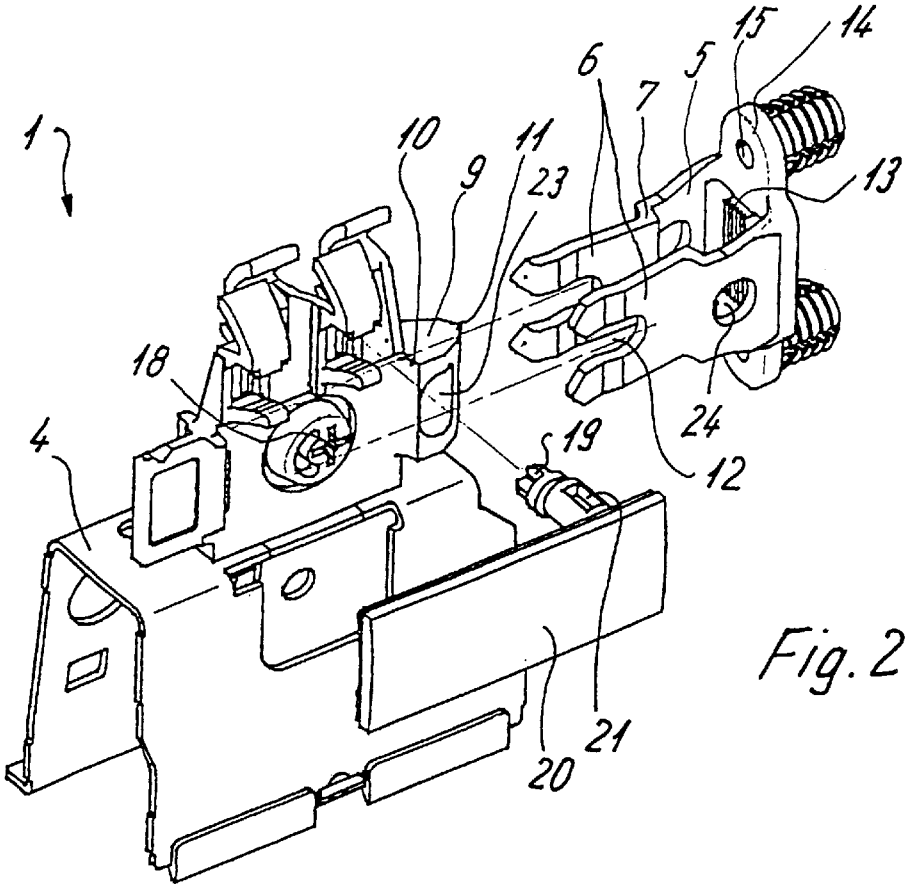
FIG. 2 is a perspective exploded view of the fastening arrangement according to FIG. 1 from the other side.
Figure 3:
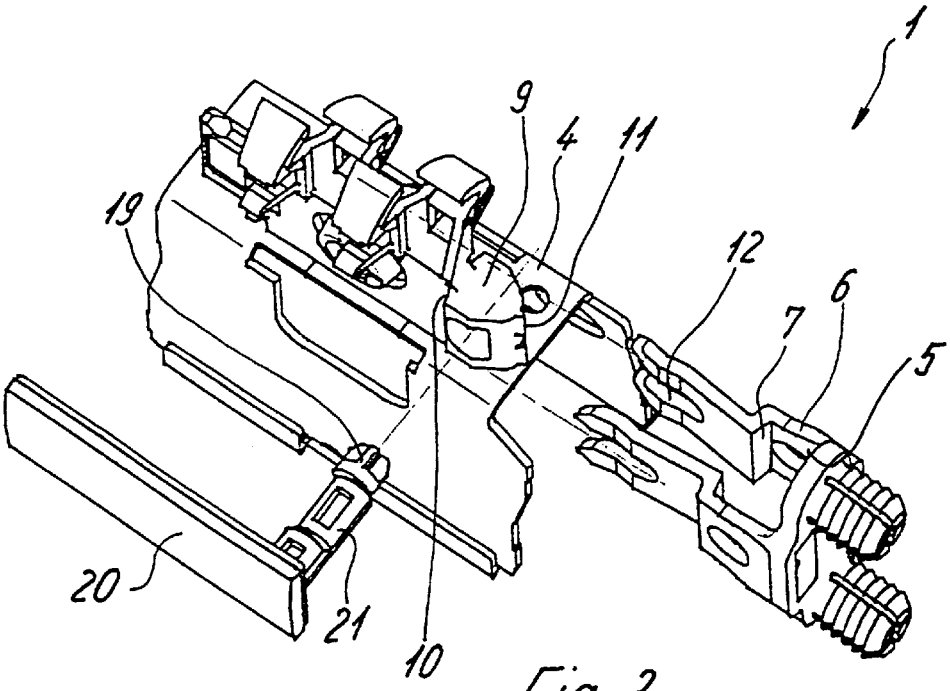
FIG. 3 is a perspective exploded view diagonally from above.

A fastening arrangement 1 has a fastening element 4, a holding part 5 and a locking lever 20. The fastening element 4 comprises a metal body which can be fixedly connected by means of the fastening arrangement (not shown) with a rail of a pull-out slide. An attachment made of a plastic material is cast onto the body made of metal, which attachment is used at least partially for fastening a front plate 3 of a drawer.

For this purpose, the holding part 5 can be connected with the fastening element 4 which, in turn, can be screwed to the front plate 3. The holding part 5 has two lateral flanges 6, on which diagonally inward extending projections 7 are provided. Slots 12 are formed at the tips 8 of the lateral flanges 6. In the end area, the tips 8 extend slightly toward the outside so that the holding part 5 can be pushed more easily onto the fastening element 4. In addition, an inclined plane 70 is provided which extends toward the inside. For the fastening to the front plate, the holding part 5 has a plate 14 which is provided with openings 15 for guiding through screws or similar devices. Fastening pins are constructed integrally with the plate 14, which fastening pins can engage in the front plate. In addition, a surface with several vertically extending ribs 13 is provided on the plate 14 between the two lateral flanges 6.

The fastening element 4 has a head 9 which is provided with a tip 11. The tip 11 is constructed such that it can engage between two ribs 13 on the holding part 5. In the rear area of the head 9, diagonally extending supporting surfaces 10 are constructed which have approximately the same slope with respect to a vertical plane perpendicular to the lateral surfaces of the fastening element 4 as the projections 7 on the holding part 5. In addition, a passage 23 is provided in the head 9, the vertical dimension of the passage 23 being larger than the vertical dimension of an opening 24 on the holding part 5.

Behind the head 9, the fastening element is provided with an eccentric device which has a disk 18 with a cross-shaped recess, a disk 16 and a pin 17. Between disk 16 and disk 18, a metal section of the fastening element 4 is provided so that the disks 16 and 18 pivot on the fastening element 4. The pin 17 as well as the cross-shaped recess in the disk 18 are arranged to be offset with respect to the pivot. By means of a rotation of the disks 16 and 18, which are constructed integrally with one another, the pin 17 is therefore moved along a circular path.

In addition, the fastening arrangement 1 has a locking lever 20 which has an eccentric section 21 on a pivot. Adjacent to the eccentric section 21, the head of a crosstip screwdriver is integrally constructed such that the locking lever 20 can be used for the mounting, particularly for adjusting the disk 18 of the eccentric device. The diameter of the pivot and of the eccentric section 21 are selected such that they can be introduced through the passage 23 and an opening 24 in the holding part 5.

For mounting the fastening arrangement, the holding part 5 is snapped onto the fastening element 4 before or after the connection with the front plate of a drawer, the two lateral flanges 6 being guided around the head 9. In the process, the lateral flanges 6 snap toward the inside, so that the projections 7 rest against the surfaces 10 and the inclined surfaces 70 are disposed on the disks 16 and 18. As a result of the diagonal alignment of the projections 7 and of the surfaces 10 and the endeavor of the lateral flanges 6 to still move slightly farther toward the inside, an elastic clamping force is applied between the tip 11 and the ribs 13, which is used for prefixing the holding part in the horizontal direction. In this position, the pin 17 on the disk 16 engages in the slot 12 of the holding part.

For a horizontal adjustment of the holding part 5 relative to the fastening element 4, the holding part 5 must therefore be displaced along the ribs 13, in which case the clamping force must be overcome. When the holding part 5 is to be offset only in the vertical direction, as a result of the head of the crosstip screwdriver 19 on the locking lever 20, the disk 18 can be rotated by means of the cross-shaped recess. As a result, the disk 16 is rotated together with the pin which moves in the slot 12. Although, because of the construction of the slot 12, which is oblong in the horizontal direction, the pin can move freely in the horizontal direction, it strikes against the fork-shaped ends of the lateral flanges 6 in the vertical direction. As a result, the holding part 5 is displaced in the vertical direction, the grooves 13 and the tip 11 being used for the exact guidance of the holding part 5.

When the holding part 5 is to be locked relative to the fastening element 4, the locking lever 20 is pushed in through the oval openings 24 at both lateral flanges 6 and the oval opening 23 on the head 9. The oval shape of the openings 23 and 24 is necessary because the pivot of the locking lever 20 has an eccentric section 21, so that, in the top view, the pivot and the eccentric section 21 have an oblong shape. In the vertical direction, the opening 23 has a greater length than the opening 24 because the holding part 5 can be locked by the eccentric device in different positions at the fastening element 4 in the vertical direction. When the eccentric section 21 is introduced into the opening 23, the locking lever 20 is rotated by 90°, so that the holding part 5 is clamped in tightly by means of the openings 24 in the lateral flanges 6 on the head 9 of the fastening element 4. In this case, the tip 11 is pressed tightly between two ribs 13. In this position, the holding part 5 is firmly locked at the fastening element 4 by means of clamping forces.

Figure 4:
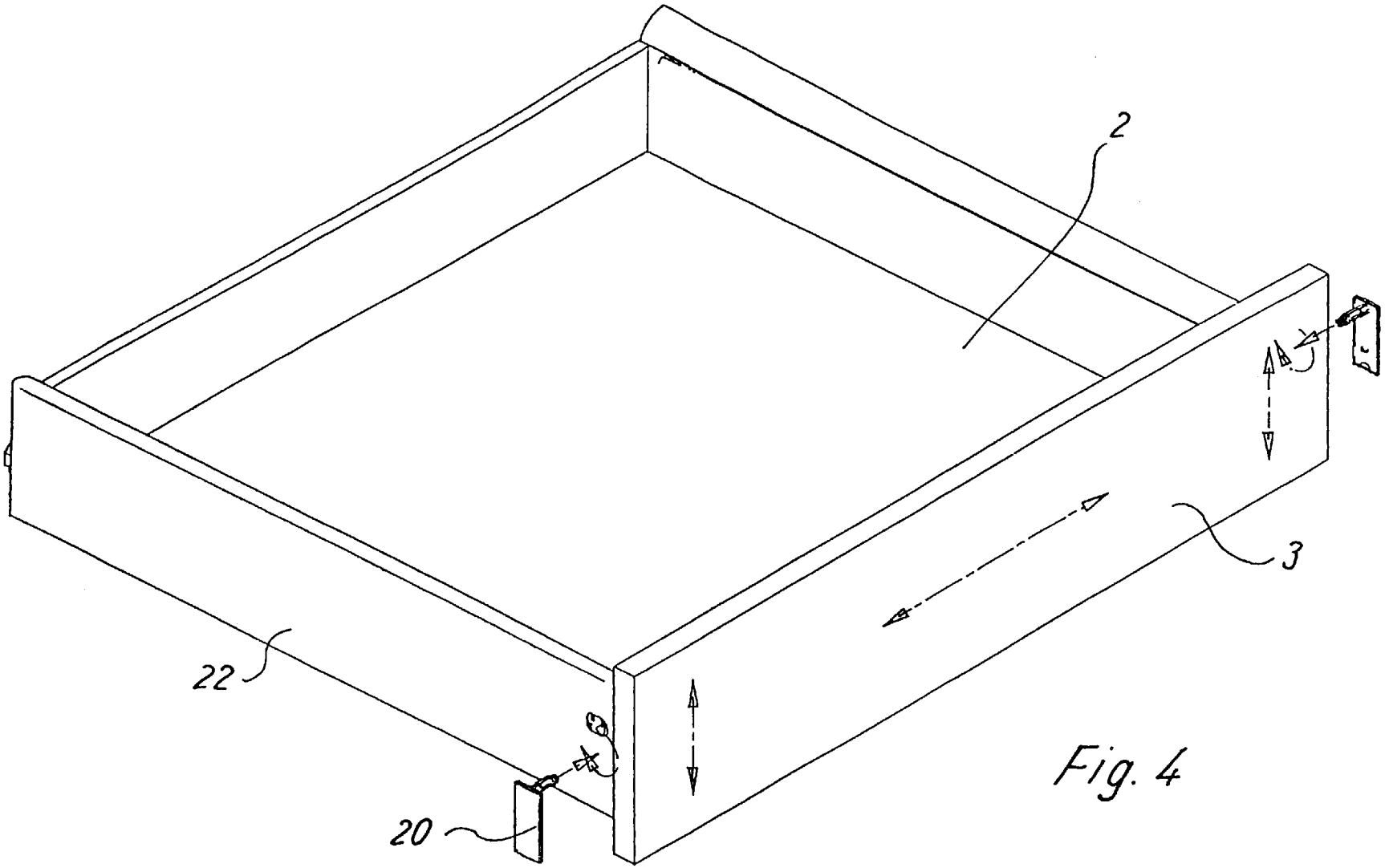
FIG. 4 is a perspective view of a drawer with two fastening devices mounted on the front panel.

As illustrated in FIG. 4, two fastening devices are mounted on a drawer in order to fasten a front plate 3 on the drawer 2. In this case, one fastening arrangement is fastened on a rail of a pull-out slide, a lateral wall 22 being inverted around the rail and the fastening arrangement. In the lateral wall 22, only one opening is provided for adjusting the front plate 3 which is situated in the area of the disk 18 of the eccentric device. For adjusting the position of the front plate 3 relative to the drawer 2, the locking lever 20 is rotated and can then be removed from the openings 23 and 24. If a vertical adjustment is required, the disk 18 with the cross-shaped recess is rotated by way of the head 19 of the locking lever 20, so that the pin 17 lifts or lowers the front plate 3 by way of the slot 12 and the holding part 5. For a horizontal adjustment, it is sufficient to move the front plate 3 toward the right or left until the tip 11 engages between two adjacent ribs 13.

After the alignment of the front plate 3, the locking lever 20 is introduced again into the openings 23 and 24 and is rotated by 90°, so that the front plate 3 is securely held on the drawer 2.

In the illustrated embodiment, the tip 11 is constructed in two parts so that the upper portion of the tip and the lower portion of the tip can engage between different ribs 13. This also permits a rotation of the holding part 5 relative to the fastening element 4, which is also relevant to application fields other than the drawer field.

In the illustrated embodiment, a combination of a snap-type device, an eccentric device and a catch device is used for the prefixing. It is also possible to provide two catch devices instead of the eccentric device or to provide two eccentric devices instead of the catch device in order to permit a simple adjustment of the front plate in the horizontal and vertical direction.

In another embodiment, an attachment is fitted onto the fastening element 4 in order to implement drawers with higher side walls. The front plate will then be fastened on the fastening element 4 as well as on the attachment in each case by way of a corresponding holding part 5. An eccentric device which has a construction similar to the eccentric device described above is provided on the attachment, which eccentric device can, however, not adjust the front plate in the vertical direction but only into an essentially horizontal direction. For this purpose, a portion of the eccentric device is disposed to be movable in the horizontal direction and can be adjusted by the rotation of the eccentric device. It is also possible to provide a catch device or clamping device instead of the eccentric device. As a result, the front plate can be adjusted also in its slope relative to a vertical plane.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A fastening arrangement for front panels of drawers the arrangement comprising:

a fastening element fastenable on a rail of a pull-out slide;

a holding part for connection with a front panel and connected to the fastening element;

eccentric devices for adjustably moving the holding part with respect to the fastening element in two orthogonal directions; and a snap-type device which holds the holding part on the fastening element, the snap-type device having two lateral flanges formed on the holding part and the lateral flanges extending partially around the fastening element with projections on the lateral flanges configured to extend toward one another and extend around at least a portion of the fastening element.

2. A fastening arrangement according to claim 1, further including a head having sloped surfaces cooperatively configured to engage the projections, wherein as the lateral flanges snap-fit around the head, ribs on the holding part grip the fastening element at its tip.

3. A fastening arrangement for front panels of drawers the arrangement comprising:

a fastening element fastenable on a rail of a pull-out slide;

a holding part for connection with a front panel and connected to the fastening element by eccentric devices which movably holds the holding part on the fastening element for adjustable movement in two orthogonal directions with respect to the front panel wherein rotation of the eccentric devices act to displace the fastening element with respect to ribs located on the holding part.

4. A fastening arrangement for front panels of drawers the arrangement comprising:

a fastening element fastenable on a rail of a pull-out slide;

a holding part for connection with a front panel and connected to the fastening element;

eccentric devices for adjustable movement, in two orthogonal directions, of the holding part with respect to the fastening element; and several ribs on the holding part and a tip on the fastening element for engaging between two of the ribs so as to fix the holding part with respect to the fastening element and permit lateral adjustment of the front panel by movement of the tip to a position between different ribs.

* * * * *